US006295994B1

(12) United States Patent
Thayer et al.

(10) Patent No.: US 6,295,994 B1
(45) Date of Patent: Oct. 2, 2001

(54) BRUSH APPLICATOR WITH ADDED HELIX

(75) Inventors: Jonathan Thayer, N. Bergen, NJ (US); Herve F. Bouix, New York, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/468,678

(22) Filed: Dec. 21, 1999

(51) Int. Cl.[7] ..... A45D 40/26; A45D 44/18; A45D 40/24; A46B 11/00

(52) U.S. Cl. ..... 132/218; 132/317; 132/313; 132/320; 401/129

(58) Field of Search ..... 132/218, 317, 132/313, 320; 401/129, 128, 122, 126, 127

(56) References Cited

U.S. PATENT DOCUMENTS

| | | | |
|---|---|---|---|
| 3,998,235 | 12/1976 | Kingsford | 132/88.5 |
| 4,114,221 | 9/1978 | Enchelmaier | 15/182 |
| 4,365,642 | 12/1982 | Costa | 132/88.5 |
| 4,490,877 | 1/1985 | Drumm | 15/182 |
| 4,498,490 | 2/1985 | Seidler | 132/88.5 |
| 4,733,425 | 3/1988 | Hartel et al. | 15/206 |
| 4,744,377 | 5/1988 | Dolan, Jr. | 132/88.5 |
| 4,861,179 | 8/1989 | Schrepf et al. | 401/129 |
| 4,887,622 | 12/1989 | Gueret | 132/320 |
| 5,161,555 | 11/1992 | Cansler et al. | 132/218 |
| 5,357,987 * | 10/1994 | Schrepf | 132/218 |
| 5,657,778 | 8/1997 | Gueret | 132/320 |
| 5,722,436 | 3/1998 | Vandromme et al. | 132/218 |

* cited by examiner

*Primary Examiner*—John J. Wilson
*Assistant Examiner*—Robyn Kieu Doan
(74) *Attorney, Agent, or Firm*—Kenyon & Kenyon

(57) ABSTRACT

A mascara applicator is disclosed that comprises a conventional twisted wire core brush with a plurality of radially extending bristles regularly disposed in a first orientation. A cylindrically configured helix is twisted onto the brush around the wire core such that the brush bristles extend radially between successive loops of the helix. The helix moves at least some of the bristles to a second orientation such that one or more characteristics of the brush may be altered. Characteristics of the original brush that may be altered include mascara retention, mascara application and combing characteristics, as well as the appearance of the brush. The dimensions of the helix, the pitch of the helix and the thickness of the helix body are each pre-selected to yield the desired characteristics in the finished brush.

34 Claims, 9 Drawing Sheets

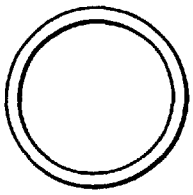
Fig. 6A
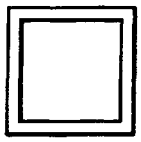
Fig. 6B
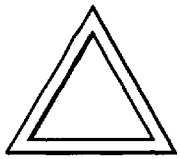
Fig. 6C
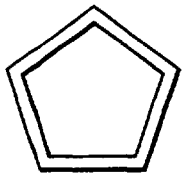
Fig. 6D
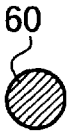
Fig. 7A
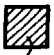
Fig. 7B
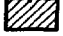
Fig. 7C
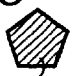
Fig. 7D
Fig. 7E
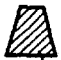
Fig. 7F
Fig. 8A
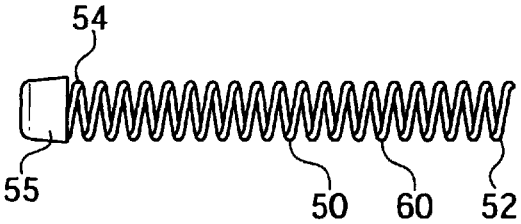
Fig. 8B
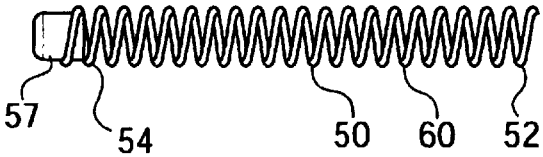
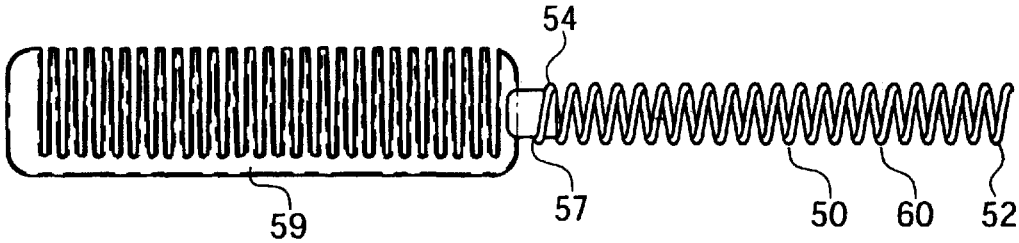
Fig. 9

BRUSH APPLICATOR WITH ADDED HELIX

BACKGROUND OF THE INVENTION

1. Field of the Invention

The present invention relates to a brush with bristles extending radially from a core such as a twisted wire core. More particularly, the invention concerns a device and method for arranging the radially extending bristles of a brush, such as a brush for applying mascara.

2. Description of the Prior Art

Brushes, such as, for example, mascara brushes used to apply mascara to a user's eyelashes, are known. A common type of mascara brush is comprised of a core formed from a single metallic wire folded in a generally unshaped configuration to provide a pair of parallel wire segments. Bristles (sometimes referred to as filaments), usually comprised of strands of nylon, are disposed between a portion of a length of the wire segments. The wire segments are then twisted, or rotated, to form a twisted wire core, which holds the filaments substantially at their midpoints so as to clamp them between the wire segments. In this way, a bristle portion or bristle head is formed with radially extending bristles secured to the twisted wire core in a spiral manner. See, for example, U.S. Pat. No. 4,887,622 to Gueret; and U.S. Pat. No. 4,733,425 to Hartel et al.

Generally, a mascara applicator is inserted into a container having a reservoir of mascara or some other cosmetic medium. The bristles are arranged so as to pick up a supply of mascara and carry it from the container for application to a user's eyelashes. See, for example, U.S. Pat. No. 4,365,642 to Costa; U.S. Pat. No. 4,733,425 to Hartel et al.; and U.S. Pat. No. 4,887,622 to Gueret. These mascara applicators are said to maximize the amount of mascara carried by the applicator and are said to apply the mascara in a uniform and attractive manner, while simultaneously combing the eyelashes in a desired fashion.

These and other objectives are generally considered to be important in mascara brush design. As noted, brushes are preferred that maximize the amount of mascara picked up by the applicator from the mascara reservoir for application to the eyelashes, thus minimizing the number of times a user must introduce the applicator into the reservoir to replenish the brush. Brushes are also preferred that apply the mascara in a uniform manner and simultaneously comb the lashes to separate and remove excess mascara from the lashes. For the convenience of the user, application and combing of lashes is preferably accomplished in as few strokes as possible, with as few introductions of the applicator into the mascara reservoir as possible.

Because cosmetic product characteristics vary, a brush design that is ideal for use with one particular cosmetic product may not be suitable for use with another cosmetic product. For example, a particular mascara formulation may be thicker, or may contain more solids, thus requiring brush characteristics different from those required by a thinner product or a product containing fewer solids.

In addition, users may favor one brush characteristic over another. For example, a user may prefer a brush that combs well but carries less product.

It is known that modifying the stiffness of the bristles or the distribution of the bristle tips of a conventional-type twisted wire brush can significantly alter, for example, the retention, application and/or combing characteristics of the brush, and may improve the esthetic appeal of the brush. For example, U.S. Pat. No. 4,733,425 to Hartel et al. discloses the use of hollow bristles or bristles having a non-circular cross-section to yield an improved bristle distribution. U.S. Pat. No. 4,861,179 to Schrepf et al. discloses soft and stiff bristles intermingled throughout the length of a brush in specified proportion so that the brush may be used both for applying mascara and combing the eyelashes. U.S. Pat. No. 5,657,778 to Gueret discloses the use of bristles having a transverse section in the shape of an L, which is said to yield an improved bristle distribution. U.S. Pat. No. 5,161,555 to Cansler et al. discloses a brush utilizing heavily waved bristles instead of straight bristles, which is said to more evenly distribute the ends of the bristles.

The known brushes, including the foregoing examples, rely on unique bristle structure (e.g., hollow, non-circular or I-shaped section) or unique bristle characteristics (e.g., intermingled soft and stiff bristles) to modify brush characteristics. Generally, the use of unique bristle components incurs higher unit costs due to higher initial cost for the components, and increased assembly costs due to unique production and process issues, e.g., the difficulty of handling heavily waved bristles. In addition, the use of a unique component may yield undesired brush characteristics or limit the degree to which brush characteristics can be modified.

Brushes are also known wherein a bristle carrying strip is arranged spirally about a core. For example, U.S. Pat. Nos. 4,490,877 to Drumm and 3,998,235 to Kingsford (FIGS. 5–6) disclose a bristle carrying strip in the form of a U-shaped channel supporting bristles. In each disclosed brush, the channel is spirally wound around a support. U.S. Pat. No. 4,114,221 to Enchelmaier discloses a bristle carrying strip with notches supporting tufts of bristles. The strip is spirally wound about a core. In each of these three disclosures, the bristles are fixed to the spiral strip, not to the core of the brush. Because the bristles are fixed to the spiral strip, the degree to which bristle distribution can be modified is limited, for example, to changes in pitch of the spiral. Furthermore, there is no indication that the disclosed structures can be used to modify the bristle distribution of an existing conventional mascara brush.

Accordingly, there is a need for a low cost brush wherein the bristle distribution can be dramatically modified during or after production, also at low cost, to meet a variety of functional and esthetic objectives.

BRIEF SUMMARY OF THE INVENTION

To overcome the deficiencies of the prior art and to achieve other objects and advantages, a mascara applicator is disclosed which comprises a conventional central core preferably formed from a twisted wire and having a brush section at one end thereof. The brush section comprises a plurality of radially extending bristles in an initial orientation, e.g., a spiral array, by the twisted wire core. A cylindrically configured helix is positioned substantially coaxially about the core such that the bristles extend radially between successive loops or coils of the helix. The characteristics of the helix, such as, for example, the internal dimension, the pitch, the thickness of the helix body, etc., are each selected to act in concert to change the initial orientation of at least some of the bristles when the helix is in position about the core. Thus, the helix changes the physical arrangement of the brush section by reorienting at least some bristles to yield a brush with selected characteristics.

A method in accordance with the present invention comprises the steps of adding to a bristle portion of a brush a helix dimensioned to be received coaxially about the core such that the bristles extend radially between successive coils of the helix. By selecting the dimensions, structure and configuration of the helix, the helix is adapted to reposition at least some of the bristles.

In accordance with the present invention, a standard twisted wire core brush may be modified at a low cost to yield a mascara applicator with bristles having a selected distribution. The bristle distribution in the applicator of the present invention can be selected to pick up and carry more mascara than conventional applicators. The bristle distribution can also be selected to apply the mascara in a smoother and more uniform manner and provide a better combing action with a reduced number of strokes when compared to conventional applicators. Furthermore, bristle characteristics of a conventional brush can be readily modified by simply adding a helix according to the present invention.

The invention and its particular features and advantages will become more apparent from the following detailed description when considered with reference to the accompanying drawings.

BRIEF DESCRIPTION OF THE DRAWINGS

FIGS. 6A–6D are schematic representations of examples of embodiments of helix loop cross-sections.

FIGS. 7A–7F are sectional views of examples of embodiments of the wire or sheet material body of the helix.

FIGS. 8A–8B are elevational views of embodiments according to the present invention with a cap and a plug, respectively, on the distal end of the helix.

FIG. 9 is an elevational view of a helix according to the present invention with a plug on the distal end of the helix and a comb supported on the plug.

DETAILED DESCRIPTION OF THE INVENTION

Like reference numbers will be used to refer to like or similar parts from figure to figure in the following description.

Figure 1:
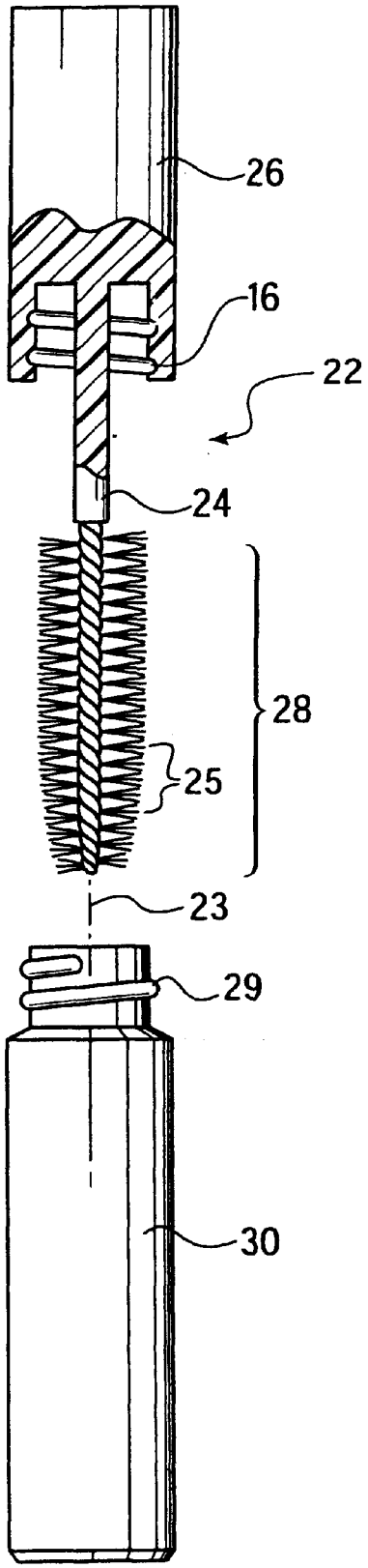
Fig. 1 (Prior Art)
FIG. 1 is an elevational view in partial section of a prior art twisted wire core brush, and a container.

Referring to FIG. 1, a prior art representative twisted wire core mascara brush assembly, shown generally at 22, has a core 24 defining a longitudinal axis 23. The core 24 supports a bristle portion 28 at one end and a cap 26 at an opposite end. The bristle portion 28 of the brush assembly 22 is dimensioned to be received in a conventional mascara container or bottle 30. The cap 26 and the container 30 are adapted to be connected by cooperatively engaging threads, 16 and 29, respectively. The twisted wire core type of brush shown in FIG. 1 and the method for making it are well known. As detailed above, such brushes are made by folding a single metallic wire in a generally unshaped configuration to provide a pair of parallel wire segments. Bristles 25 (sometimes referred to as filaments), usually comprised of strands of nylon, are disposed between a portion of a length of the wire segments. The wire segments are then twisted to form a twisted wire core, which holds the filaments substantially at their midpoints so as to clamp them. In this way, the bristle portion 28 (sometimes referred to as the bristle head) is formed with regularly disposed radially extending bristles 25 secured to the twisted wire core in a spiral manner. In FIG. 1, the bristle portion 28 of the prior art brush assembly 22 is shown as having a particular bristle envelope (also known as a brush trim), i.e., the shape of the brush defined by the bristle tips. The brush shown has a generally cylindrical bristle envelope tapered at one end, with bristles arranged in a spiral twist which is more apparent at the core 24 than at the surface of the bristle envelope.

At the surface of the bristle envelope of the prior art brush depicted in FIG. 1, the bristle tips are substantially uniformly distributed relative to one another. However, as described in greater detail below, the present invention will work equally well with brushes having bristle tips distributed any manner. Also, while this invention is disclosed with respect to twisted wire core brushes, it will be understood that the invention will work equally well with other types of brushes that have bristles extending radially from a core, and that would benefit from a reorientation of individual bristles or a redistribution of bristle tips.

It is generally understood in the art of making twisted wire core brushes that the terms helical and spiral, and helically and spirally, are interchangeable when referring to the configuration of the twisted wire segments, and/or when referring to the arrangement of bristles relative to the core of the brush. For example, a twisted wire core brush with bristles arranged spirally about the core is generally understood to be the same as a twisted wire core brush with bristles arranged helically about the core. However, for the sake of clarity in the present disclosure, the terms spiral and spirally will be primarily be used in connection with the original or initial brush, i.e., the configuration of the twisted wire segments and/or the arrangement of bristles on the core of the original or initial brush. The terms helical or helically will primarily be used in connection with the added helix. In each case, the predominent usage is solely intended to be for the sake of clarity in the present disclosure, and is not intended to imply that the terms have been defined to be different from the general understanding in the art.

Figure 2:
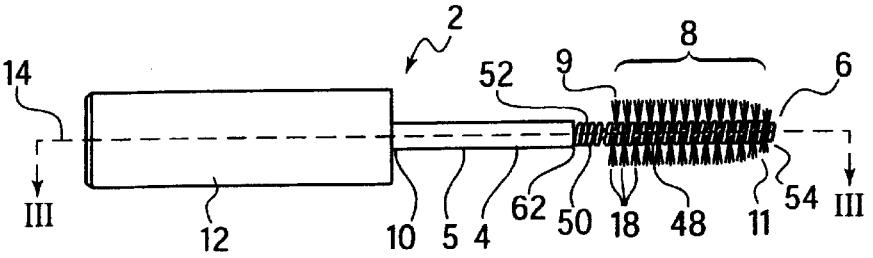
FIG. 2 is an elevational view of an applicator brush assembly according to the present invention.
Figure 3:
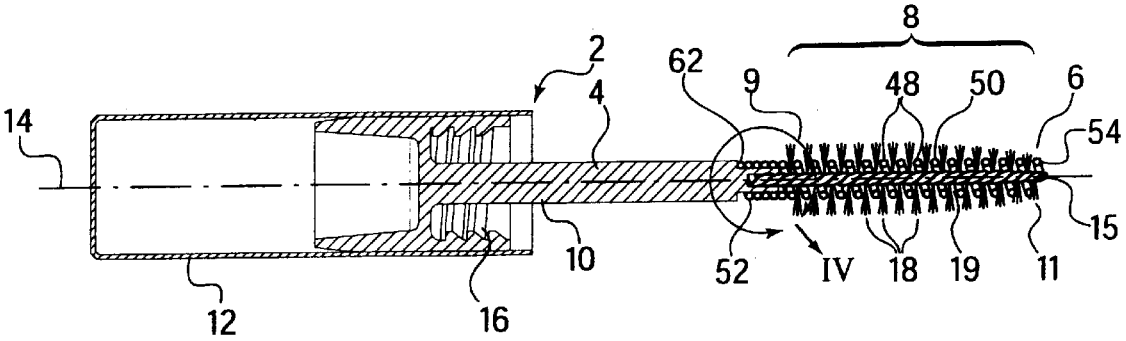
FIG. 3 is a cross-sectional view of the applicator brush according to the invention taken along line 3—3 in FIG. 2.
Figure 4:
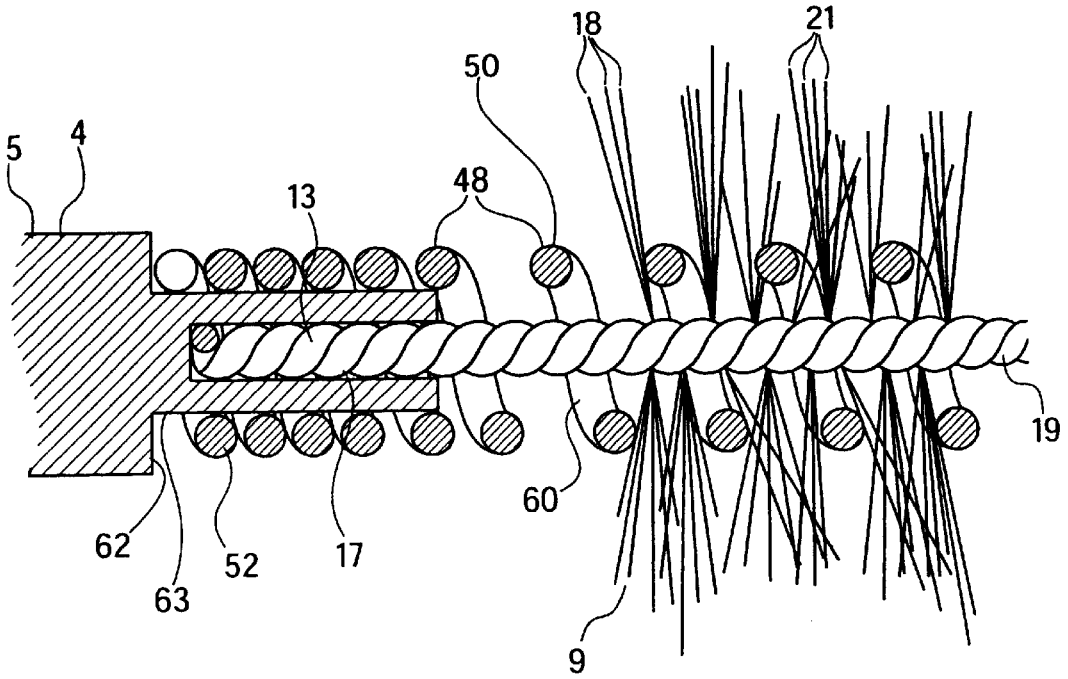
FIG. 4 is a cross-sectional detail view of an embodiment of the present invention showing a connection between the helix and the applicator core taken from FIG. 3.

Referring now to FIGS. 2–4, a mascara brush assembly according to the present invention is shown generally at 2. The brush assembly 2 has a central core 4 supporting a bristle portion 8 at a first end 6 and a cap 12 at a second end 10. The cap 12, which also serves as a handle for the brush, has internal threads 16 (FIG. 3) for securing the brush assembly 2 to a conventional mascara bottle such as that indicated by reference number 30 in FIG. 1. The bristle portion has a proximal end 9 closer to the second end 10 and a distal end 11 at a greater distance from the second end 10. A longitudinal axis 14 is defined through the first end 6 and the second end 10 of the core. All or a portion of the core 4 may comprise a solid material, such as, for example, molded plastic, with the bristles secured in the material by conventional means. Alternatively, all or a portion of the core may comprise a twisted wire 19. The twisted wire portion 19 of the core 4 is connected to the solid portion of the core by conventional means, e.g., by bonding, sonic welding, molding, interference fit, or otherwise fastening a proximal end 13 of the twisted wire portion 19 in a bore 17 (FIG. 4) in the solid portion of the core 4. In the preferred embodiment, the second end 10 and a central part 5 of the core 4 are a solid plastic material, and the first end 6 of the core 4 is a conventional twisted wire portion 19.

In any case, a plurality of radially extending bristles 18 are secured along the bristle portion 8 of the core 4 to yield an "original brush" having bristles with an "initial" or "first" distribution or orientation. Bristle distribution (also known as bristle tip distribution) refers to the location of a bristle tips relative to one another in the bristle portion of the brush assembly. Bristle orientation refers to the spacial position of a bristle shaft relative to core of the brush assembly in the bristle portion. In the present application, the terms "original brush" or "initial brush" refers to a brush before a helix according to the present invention is coaxially installed and "subsequent brush" or "final brush" refers to a brush after the helix according to the present invention has been installed. Similarly, "original", "initial" or "first" distribution or orientation refers to a bristle arrangement before a helix according to the present invention is coaxially installed, and "subsequent", "final" or "second" distribution or orientation refers to a bristle arrangement after a helix according to the present invention has been added.

In the preferred embodiment, at least the bristle portion 8 of the core is a twisted wire portion 19, with bristles 18 clamped securely at their mid-point between the wire segments of the twisted wire. Each of the bristles 18 of the original brush, at least initially (i.e., before a helix is added to the bristle portion of the original brush) has a first orientation relative to the core 4, which in turn defines a first bristle distribution. This first bristle orientation and distribution would typically be that found in any conventional twisted wire brush, thus it will be understood that the invention will work equally well with bristles having other first bristle orientations and distributions.

The initial or first distribution of the bristles of the original brush may not be ideal for all intended purposes or intended mascara formulations. For example, an initial distribution of bristles may yield a particular bristle envelope 112 (as represented schematically in FIGS. 27–28), i.e., the surface of the bristle portion of a brush that is defined by an arrangement of the bristle tips. One type of bristle envelope may have grooves or clearances 104 (FIG. 28) that exhibit, for example, better loading characteristics but less desirable combing characteristics. Another bristle distribution would yield a smooth bristle envelope free of grooves or clearances (FIG. 27) that exhibits, for example, better combing characteristics, but less desirable loading characteristics.

The present invention permits an initial bristle distribution of an original is brush to be altered by moving at least some of the bristles from their first orientation to a selected second orientation. This is accomplished with a cylindrical-type helix 50, also referred to herein as an "added helix", that is provided to at least part of the length of the bristle portion 8 of the brush assembly 2. The helix 50 comprises a body 60 (FIG. 4) formed into a plurality of successive loops 48 that extend from a proximal end 52 to a distal end 54. The helix 50 is positioned substantially coaxially about the core 4 in the bristle portion 8 of the brush. In other words, loops 48 of the body 60 of the helix 50 spiral about the core 4. The helix 50 is positioned about the core 4 such that the bristles 18 extend radially between adjacent ones of the successive loops 48. Thus, at least some portions of the helix 50 occupy space between bristles 18, and at least some of the bristles 18 are repositioned to a second orientation relative to the core 4 by contact, either directly or indirectly, with the helix 50 (see FIG.4). By repositioning some of the bristles 18, a distribution of the bristle tips 21 is achieved (see FIGS. 2–4) that is different from the distribution of bristle tips in an original brush without an added helix (see FIG. 1). The dimensions of the helix may be selected such that the resulting brush has significantly different properties than the original brush.

Figure 5A:
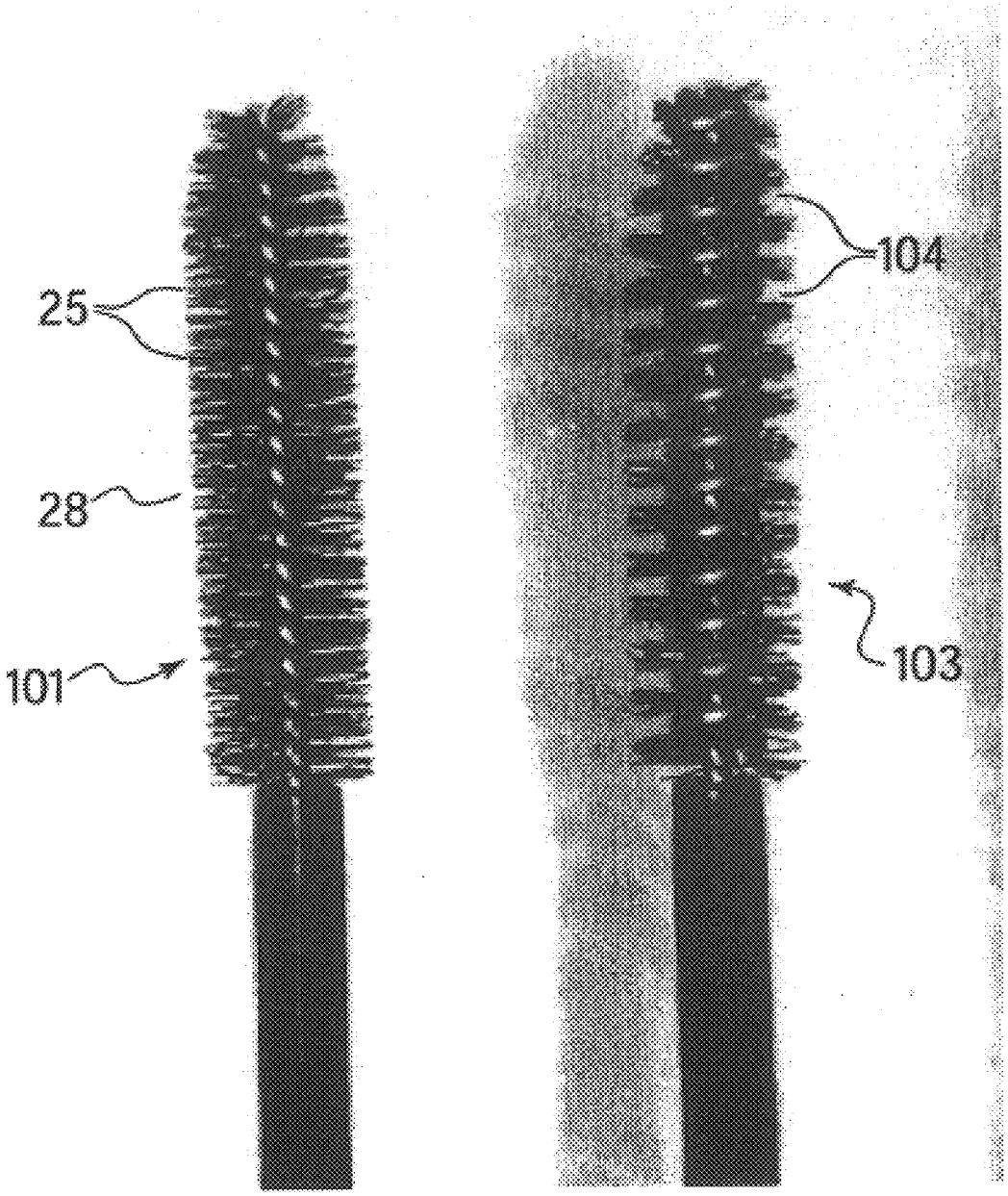
FIG. 5A is a photograph showing a side-by-side comparison of an original brush and an identical brush after modification with the helix of the present invention demonstrating redistribution of the bristles from a substantially uniform distribution to a spiral row-like distribution.
Figure 5B:
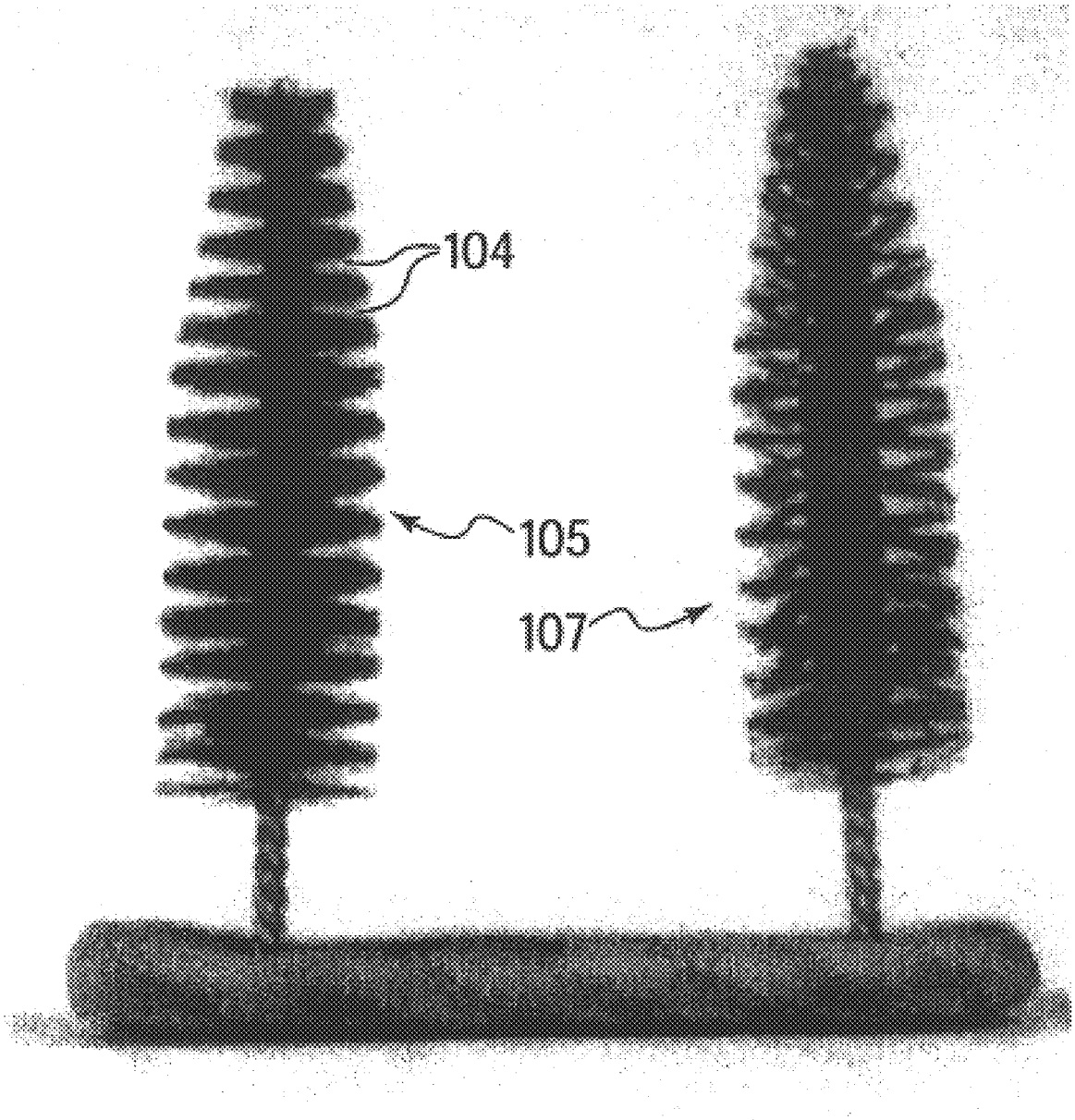
FIG. 5B is a photograph showing a side-by-side comparison of an original brush and an identical brush after modification with the helix of the present invention demonstrating redistribution of the bristles from a spiral row-like distribution to a substantially uniform distribution.
Figure 11:
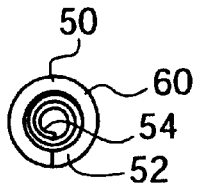
FIG. 11 is an end view of the helix taken in the direction of arrows 11—11 in FIG. 10.

As explained in greater detail below, the added helix 50 can be selected to arrive at a variety of different bristle distributions. For example, a brush with a smooth bristle envelope (i.e., a relatively uniform bristle tip distribution—represented schematically in FIG. 27) can be modified to have a bristle envelope with grooves or clearances (i.e., a spiral row of bristles—represented schematically in FIG. 28). This is illustrated in FIG. 5A which shows a side-by-side comparison of an original brush 101 having a substantially smooth bristle envelope and an identical brush 103 after modification with an added helix has yielded a bristle envelope with a clearance or groove 104 (a spiral row of bristles). Alternatively, an original brush with an initial distribution defining a bristle envelope with clearances or grooves (i.e., a spiral row of bristles—FIG. 28) can be modified with a helix to have a substantially smooth bristle envelope (i.e., a substantially uniform distribution of bristle tips—FIG. 27) with almost no apparent clearances or grooves. This is illustrated in FIG. 5B with a side-by-side comparison of an original brush 105 having a bristle envelope with clearances or grooves 104 (a spiral row of bristles), and an identical brush 107 after modification with an added helix has yielded a substantially smooth bristle envelope (a substantially uniform bristle tip distribution). It will be understood that an original brush with a bristle envelope having a groove may also be modified with an added helix to change the apparent pitch, width or depth of the groove. The great advantage of the present invention is that the added helix permits an existing low cost original brush to be modified, also at a low cost, to any one of an infinite variety of bristle distributions having any one or a combination of brush characteristics and properties.

In addition to altering the bristle distribution, the added helix may increase the apparent stiffness of some of the bristles. This has the added advantage of providing a brush with characteristics typical of stiffer bristles, such as, for example, improved combing capabilities. The added helix may also improve the overall stiffness of the core of certain brushes in the bristle portion. Thus, an underlying original brush may be used that has a more delicate construction, such as a thin wire diameter, that would otherwise not have sufficient strength to function in the intended use.

Figure 10:
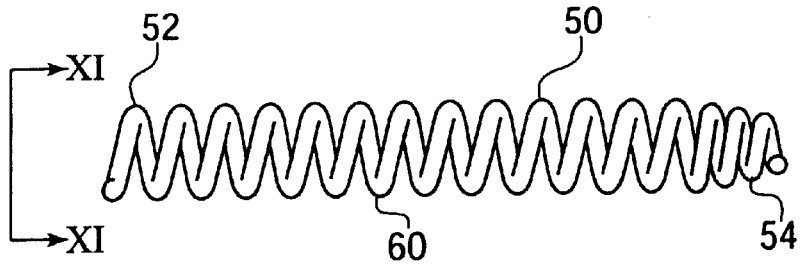
FIG. 10 is an elevational view of a preferred embodiment of the helix according to the present invention.

Preferably, the helix 50 is pre-formed apart from the brush assembly 2 by conventional methods such as, for example, those known for winding helical springs. The helix 50 is pre-formed with such characteristics as dimension, pitch and shape selected to provide predetermined characteristics to an original brush on which it is installed. In the preferred embodiment, a helix 50 is pre-formed from metal wire such that it is adapted to be installed coaxially about the core. To facilitate installation on the brush assembly, the helix 50 (shown apart from the brush assembly in FIG. 10) has uniformly spaced loops extending from the proximal end 52 through the central portion. The distal end 54 tapers to an inner diameter that is substantially the same as or slightly smaller than the diameter of the core 4 at the first end 6 (FIGS. 2–3). To install the helix 50, the proximal end 52 of the helix is placed over the first end 6 of the core 4. Then at least one of the helix 50 and the core 4 are rotated axially relative to the other such that the helix 50 advances coaxially over the core 4 in the bristle portion 8. The helix 50 preferably has a length substantially equal to that of the bristle portion 8. Preferably, the helix 50 is advanced onto the core 4 until the distal end 54 of the helix 50 is located substantially at the distal end 11 of the bristle portion 8. Preferably, the inside diameter of the distal end 54 of the helix 50 is substantially the same as or slightly smaller than the outside diameter of the end 6 of the core 4, so that the distal end 54 of the helix 50 engages the end 6 of the core 4 in an interference fit to secure the helix on the brush assembly. It will be understood that the helix may have a length shorter than that of the bristle portion 8, so that either one or both ends 52, 54 are positioned between opposite ends 9, 11 of the bristle portion. In this way, characteristics of a selected part of the bristle portion can be altered.

Alternatively, the helix can be formed in place on the brush assembly 2 by wrapping the body 60 of a helix 50 about the core 4 to achieve a selected dimension, shape and pitch, and to achieve a pre-determined bristle distribution.

Figure 13:
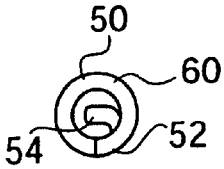
FIG. 13 is an end view of the alternative embodiment of the helix taken in the direction of arrows 13—13 in FIG. 12.
Figure 12:
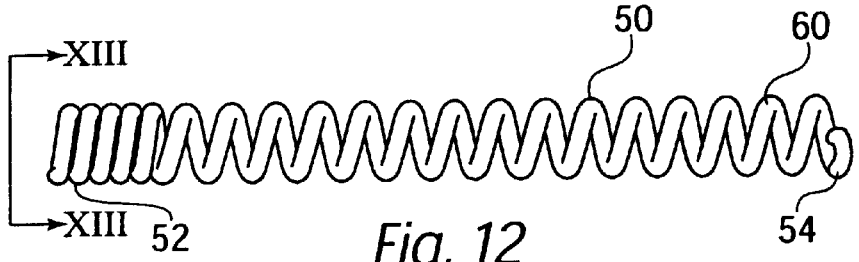
FIG. 12 is an elevational view of an alternative embodiment of the helix according to the invention.
Figure 15:
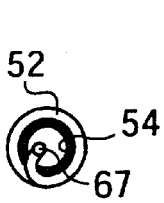
FIG. 15 is an end view of the alternative embodiment of the helix taken in the direction of arrows 15—15 in FIG. 14.
Figure 14:
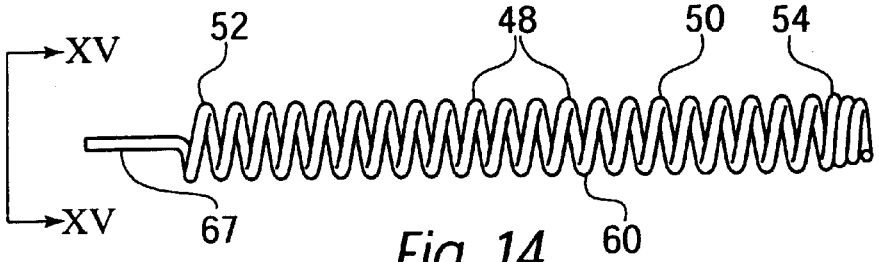
FIG. 14 is an elevational view of another alternative embodiment of the helix according to the invention.
Figure 24:
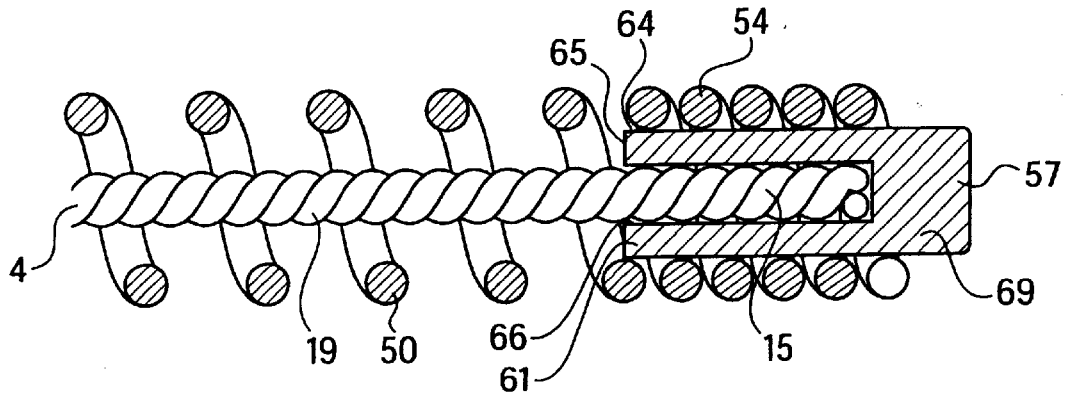
FIGS. 24–26 are partial sectional views showing various embodiments of the connection of the helix to the core at the distal end of the brush assembly.
Figure 25:
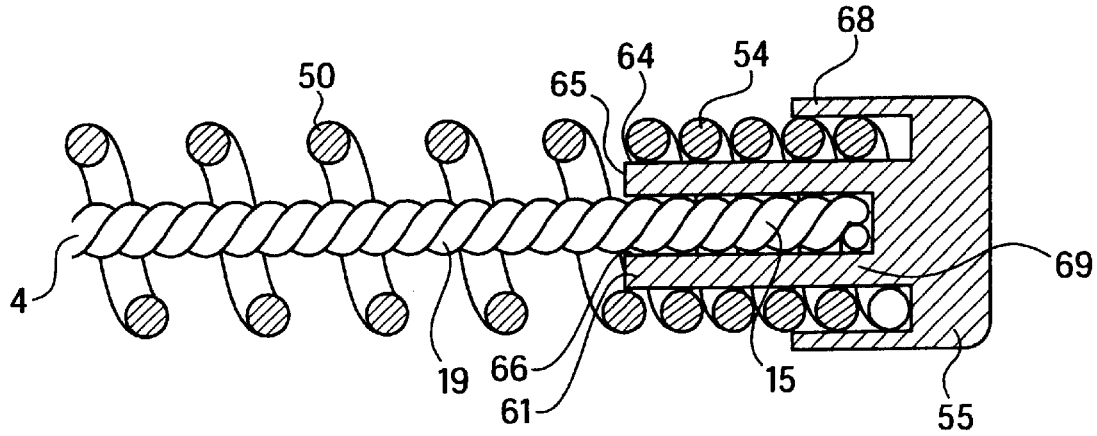

The proximal end 52 and distal end 54 of the helix 50 may be shaped or finished differently from a central part of the helix. For example, to avoid sharp points or edges that could injure the user, the distal end 54 of the body 60 of the helix may be bent back on itself to be directed into the core 4 (see FIGS. 12 and 13). Alternatively, a cap 55 (FIGS. 8A and 25) secured over the distal end 54 of the helix, or a plug 57 (FIGS. 8B and 24) secured in the distal end 54 of the helix, by, for example, interference fit or adhesive, may serve to close and finish the end. The cap 55 or plug 57 may support a comb 59 (see, for example, FIG. 9) or other specialized accessory device. Sharp points or edges can also be avoided by installing the helix 50 on the bristle portion 8 such that the distal end 54 is positioned between opposite ends of the bristle portion 8, i.e., such that the distal end 11 of the bristle portion 8 projects out from the distal end 54 of the helix 50.

Although frictional contact of the loops 48 of the helix 50 with the bristles 18 of the bristle portion 8 will generally be sufficient to retain the helix 50 on the brush assembly, anchoring means are preferably provided to more securely attach the helix on the brush assembly. The anchoring means may take the form of a structural modification to the helix. For example, one or both ends 52, 54 of the helix may be tapered to an inside dimension that is substantially equal to or slightly smaller than the outside diameter of the core 4 (see FIGS. 10, 11, 14 and 15 showing a taper provided to distal end 54). With such dimensions, the end or ends would be received on the core in an interference fit that would secure the helix to the brush assembly. Alternatively, an extension 67 (FIGS. 14–15) may be provided to one or both ends 52, 54. For example, an extension 67 projecting from the proximal end 52 would be received and secured in the bore 17 along with the end 13 of the twisted wire portion 19 of the core. Or another bore (not shown) may be provided specifically to receive and secure the extension 67 projecting from the proximal end 52. An extension 67 projecting from the distal end 54 could be folded back on itself, such that the free end of the projection could be secured to or between the twisted wire segments of the core 4.

The anchoring means may alternatively take the form of a modification to the core of the brush. For example, the first end 6 of the core 4 may be provided with an annular shoulder 62. The annular shoulder is defined by the intersection of a portion of the core 4 that has a diameter equal to or greater than a diameter of the proximal end 52 of the helix, and a reduced diameter portion 63 of the core 4. The reduced diameter portion 63 may be dimensioned to receive in an interference fit the proximal end 52 of the helix 50. In that case, the proximal end 52 is preferably tightly wound to provide greater frictional contact between the helix 50 and the core 4. The shoulder 62 may also serve as a stop, preventing the helix 50 from being advanced further up on the core 4 during assembly of the applicator brush.

Figure 26:
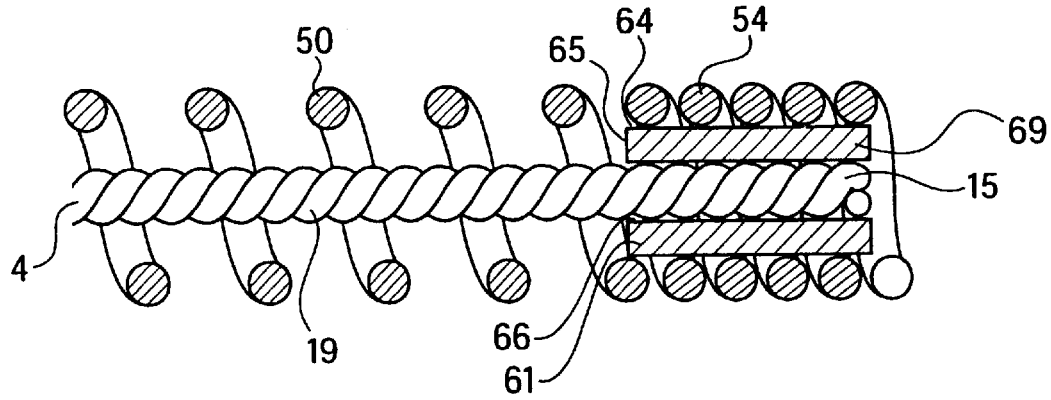

The anchoring means may also take the form of a separate component that secures the helix 50 to the core 4 of the brush. For example, a sleeve 61 (FIG. 26) may be provided between the outside of the core 4 and the inside of the helix 5. The longitudinally extending sleeve 61 has an open proximal end 65 and a distal end 69, which may or may not be open. A bore 66 defined by the sleeve 61 is dimensioned to closely receive a part of the twisted wire portion 19 of the core 4. An outer surface 64 of the sleeve is dimensioned to be closely received inside the helix 50. Preferably, the sleeve 61 is positioned between an outside of the distal end 15 of the twisted wire portion 19 of the core, and an inside of the distal end 54 of the helix. The sleeve 61 may be made of any suitable material, such as, for example, metal or plastic. A plastic material may be preferable for ease of manufacture by extrusion or molding. The sleeve may be secured to the core 4 and the helix 50 by interference fit, bonding, sonic welding or other suitable means, or a combination thereof. The distal end 69 of the sleeve 61 may optionally be attached to or integrally formed with the cap 55 or plug 57 (see FIGS. 24 and 25). In the case of the cap 55 (FIG. 25), a skirt 68 extending proximally from the cap may provide an additional attachment opportunity by being dimensioned to fit closely over the outside of the distal end 54 of the helix 50.

It will be understood that the helix 50 may be securely attached to the core by anchoring means at one or both ends 52, 54 of the helix.

Figure 16:
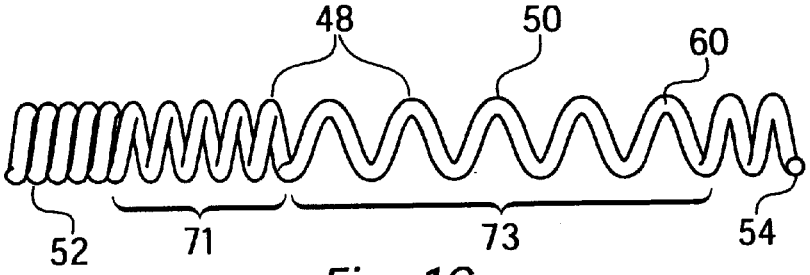
FIG. 16 is an elevational view of another alternative embodiment of the helix according to the invention.

The spacing of the loops 48 of the helix 50 may vary over the length of the helix 50. For example, a portion of the helix at one or both ends 52, 54 may be tightly wound with no gaps between loops (see FIGS. 12, 14, 16 and 17) to strengthen the helix and underlying brush, and to provide a secure attachment to the brush assembly as described above. Helixes having a tightly wound end portion will generally be positioned on the bristle portion such that the tightly wound portion does not interfere with the bristles (see FIGS. 2–3). To provide uniform brush characteristics over the length of the bristle portion, spacing of the loops 48 should be uniform in a corresponding portion of the helix 50 (see FIGS. 10, 12, 14 and 17). FIG. 16 shows an alternative embodiment with the spacing of the loops 48 varying over the length of the central portion of the helix 50. Loops in portion 71 are narrowly spaced, while loops in portion 73 are broadly spaced. When installed on an original brush with a relatively uniform initial bristle distribution over the length of the bristle portion, a helix arrangement such as that shown in FIG. 16 will yield a bristle distribution and brush characteristics that vary over the length of the bristle portion.

Figure 17:
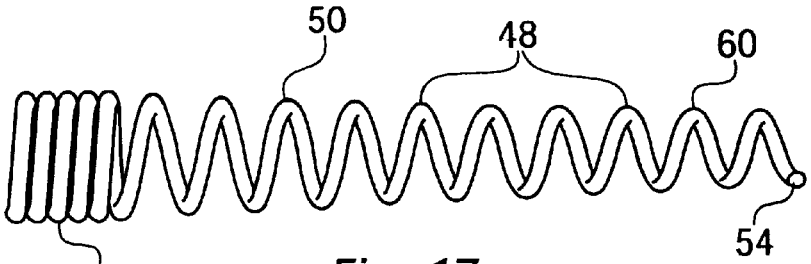
FIG. 17 is an elevational view of another alternative embodiment of the helix according to the invention.

In FIG. 17, an embodiment is shown in which the diameter of the helix gradually tapers from the proximal end 52 to the distal end 54. This taper of the helix diameter can correspond to a taper of the bristle trim, or vary from a taper of the bristle trim. In the case of a helix tapering differently from a bristle trim taper, the helix will in most cases yield a bristle portion with bristles of varying stiffness over the length of the bristle portion.

The body 60 of the helix may be made from any suitable material that is compatible with the intended use. The body 60 may be shaped, cut or otherwise worked from a wire or a sheet-like material such as metal or plastic, or molded from a plastic or other suitable material. Preferably the body 60 is made from metal wire or sheet metal. The dimensions of the body 60, i.e., the diameter of the wire, or thickness of the sheet metal, etc., and the sectional shape of the body 60 may be selected to achieve a desired distribution of bristles. Examples of sections of body 60 are shown in FIGS. 7A–7f. These examples are not intended to be limiting.

Figure 19:
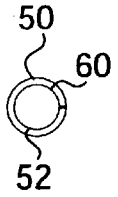
FIG. 19 is an end view of the alternative embodiment of the helix taken in the direction of the arrows 19—19 in FIG. 18.
Figure 18:
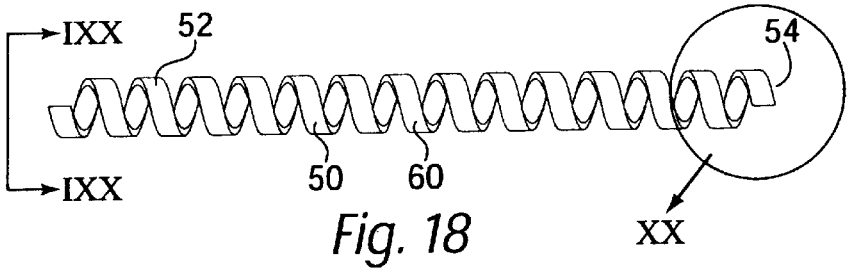
FIG. 18 is an elevational view of another alternative embodiment of the helix according to the invention.
Figure 20A:
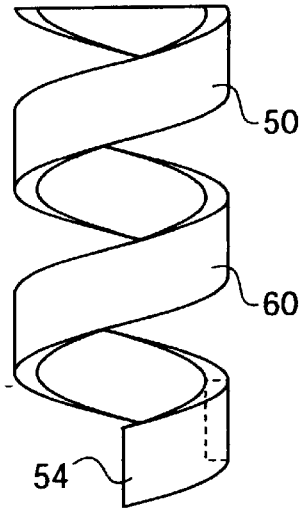
FIGS. 20A–20F are detail views of the distal end of the helix shown generally in FIG. 18, with the detail views in FIGS. 20C–20F showing examples of alternative surface treatments.
Figure 20B:
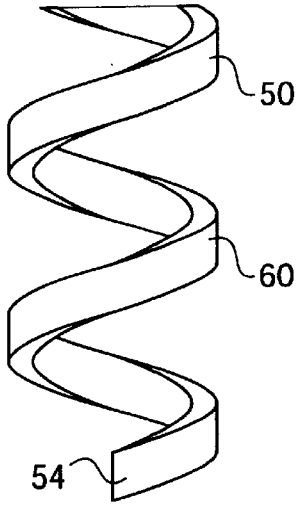
Figure 20C:
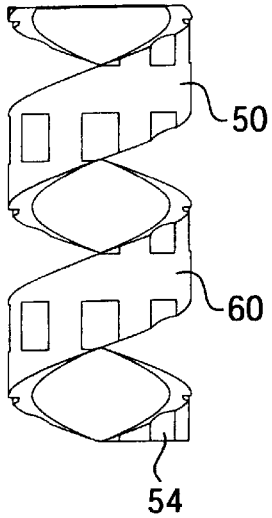
Figure 20D:
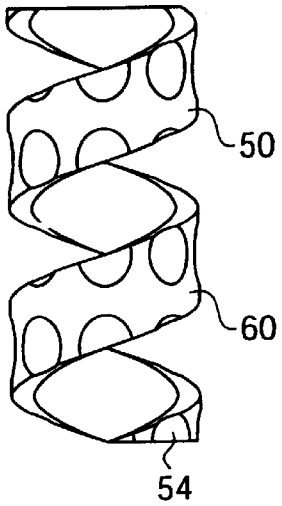
Figure 20E:
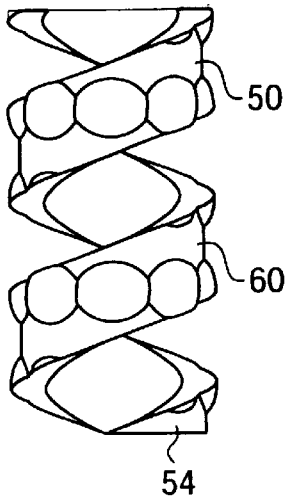
Figure 20F:
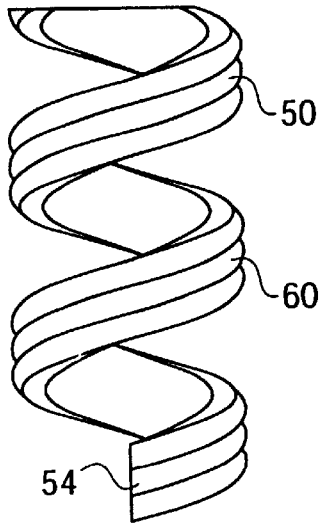
Figure 22:
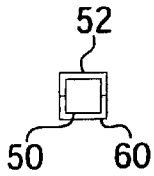
FIG. 22 is an end view of the alternative embodiment of the helix taken in the direction of the arrows 22—22 in FIG. 21.
Figure 21:
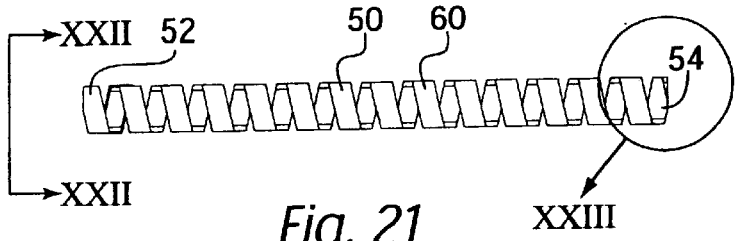
FIG. 21 is an elevational view of another alternative embodiment of the helix according to the invention.
Figure 23:
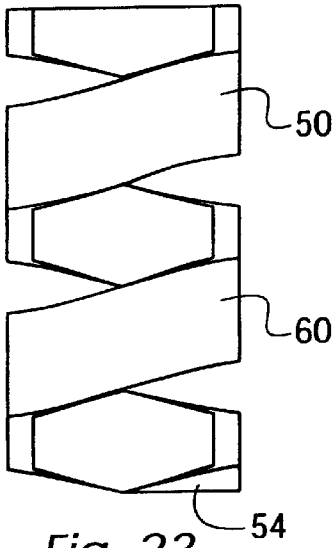
FIG. 23 is a detail view of the distal end of the helix shown in FIG. 21.

The wire or sheet material body 60 of the helix may be otherwise modified to achieve desired results. For example, a helix body 60 made from a wire (FIGS. 10–17) or a sheet material (FIGS. 18–19) may be grooved or perforated or otherwise worked to enhance function, by for example increasing the surface area of the body 60. Examples of various modifications that could be provided to the sheet material helix 50 shown in FIGS. 18–19 are depicted in detail views in FIGS. 20A–20F. FIG. 20A shows a sheet material helix body that is unmodified. FIG. 20B shows a sheet material helix with a body section that decreases in the direction of the end 54 so that the body 60 gradually tapers toward end 54. FIGS. 20C–20E show sheet material helix bodies with various examples of convex or concave dimpling that can enhance mascara retention on the brush. FIG. 20F shows a sheet material helix body with surface grooves that can enhance mascara retention. FIGS. 21–23 show a helix 50 with a sheet material helix body 60. The helix has a square cross-section. Other examples of alternative cross-sections of the helix are shown in FIGS. 6A–6D. A helix body 60 made of any suitable material may be rigid such that it provides additional stiffness to the bristle portion of the brush. Alternatively, the helix body 60 may have spring-like or elastic qualities that permit the helix to expand to be received on the bristle portion of the brush assembly, and contract to grip the bristle portion to be retained on the brush assembly. The helix may be fully or partially flocked with fibers by methods well known in the art.

The structure and shape of the helix 50 is selected to yield a desired bristle distribution. For example, the pitch and/or overall diameter of the helix can be selected relative to the diameter of the core and the length of the bristles to arrive at a desired bristle distribution. The pitch and/or the diameter of the helix may be uniform or vary along the length of the helix. As noted above, the radial cross-sectional shape of the helix 50 and/or the helix body 60 can also influence the distribution of bristles. For example, the helix 50 may define a passage with a circular radial cross-section, or a non-circular radial cross-section, such as, for example, a square, an oval or a star shaped section. Similarly, an exterior radial cross-sectional shape of the helix 50 may be circular or non-circular, e.g., square, oval, star-shaped, etc., to arrive at different bristle distributions in the bristle portion 8 of the brush. The radial cross-sectional shape of the helix may be uniform or vary over its length.

The dimensions of the wire or sheet material helix body 60 and physical properties of the material from which the helix is made will also affect the ultimate bristle distribution achieved. For example, as shown in FIGS. 7A–7F, the cross-section of the wire or sheet material of the helix body 60 may be circular or non-circular (oval, square, rectangular, star-shaped, etc). The material from which the helix body is made may vary along its length in degree of elasticity or rigidity. The spiral shape of the helix body 60 may consist of uniform, repetitive loops, each having a smooth contour. Alternatively, the helix body may consist of loops that are not uniform in shape, or loops that have angular contours taken in radial directions (see, for example, FIGS. 6C, 6D and 22) or longitudinal directions.

More than one helix may be installed coaxially on a brush, i.e., with a first helix positioned coaxially about the core, and a second helix positioned coaxially about the first helix and the core. The pitch of each of the first and second helices may be in phase or out of phase with the other. In addition, the wire segments 19 of the core 4 may be twisted in a first direction, while the loops of the helix 50 spiral in the same direction or an opposite direction from that of the core.

The effect that a helix with particular dimensions has on a particular original brush will depend on a number of variable factors, including, but not limited to, the bristle orientation, distribution and density of the original brush, bristle characteristics of the original brush (thickness, stiffness, structure, e.g., wavy, hollow, etc.). Other factors include the thickness and cross-sectional shape of the helix body, the pitch of the helix, the stiffness of the helix, the dimension of the helix relative to the original brush, core diameter relative to the helix diameter, etc. In view of the numerous variables involved, the following guidelines have been found to be useful in selecting a suitable helix for a desired result.

The minimum inner diameter defined by the helix should preferably be close to the outside diameter of the core of the brush in the bristle portion (or, if the helix is expandable, slightly smaller than the core). Preferably, the radial cross-section of the helix should not exceed a radial cross-section defined by the bristle envelope of the brush. Embodiments are also contemplated in which the radial cross-section of either the helix or the bristle envelope is either eccentric, or radially offset from the core of brush such that a portion of the radial cross-section of the helix extends beyond the bristle envelope. However, the helix should not extend so far beyond the envelope that lashes or hair can no longer contact at least some of the bristles by passing between loops of helix.

In the case of an original brush that is a twisted wire core brush, the most significant factor determining the final bristle distribution appears to be the number of turns per unit of measure (e.g., the number of loops per inch) of the helix relative to the number of turns per unit of measure (e.g., the number of twists or spirals per inch) of the twisted wire core of the bristle portion of the original brush. If the number of turns per inch of the helix is greater than the number of turns per inch of the twisted wire core, the bristles will tend to splay toward a uniform tip distribution regardless of whether the initial bristle distribution of the original brush is uniform (i.e., a smooth bristle envelope 112 free of grooves or clearances—as represented schematically in FIG. 27) or spiral row-like (i.e., a groove or clearance 104 in the bristle envelope 112—as represented schematically in FIG. 28). If the number of turns per inch of the helix is less than the number of turns per inch of the twisted wire core, the helix will tend to segregate bristles into a spiral row-like distribution (FIG. 28). However, when a helix having less turns per inch than a brush core is added to an original brush with an initial spiral row-like bristle distribution, the direction of twist of the helix 50 should be opposite the direction of twist of the twisted wire portion 19 of the core 4, i.e., opposite the direction of twist of the initial spiral row-like distribution, to avoid anomalies in bristle distribution (represented schematically at 119, 120 in FIG. 29) that may occurr at points corresponding to the crossing of twists of the helix with the twists of the spiral pattern of the initial bristle distribution. The anomalies 119, 120 take the form of small groups of bristles (120) splayed across the groove or clearance 104 of the spiral row-like distribution, or gaps (119) in the row of bristles. When the direction of twist of the helix is opposite from that of the core, the anomalies 119, 120, shown schematically in FIG. 29, form a kink 122 or wave 124 in the spiral row at evenly spaced intervals to yield a bristle distribution that may be desirable for some applications. However, if a final spiral row-like bristle distribution free of anomalies is desired, the best results are yielded by adding the helix to an original brush with an initial bristle distribution that is uniform.

Figure 27:
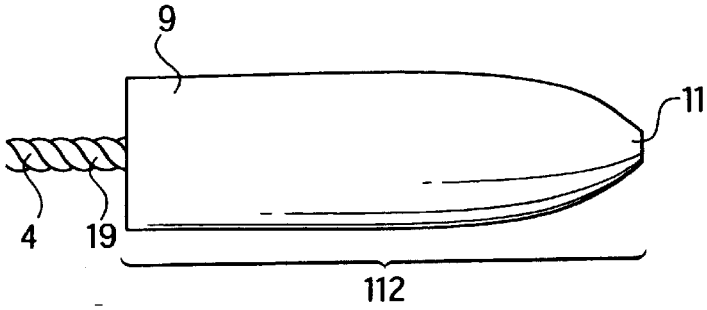
FIG. 27 is a schematic representation of a typical smooth bristle envelope, i.e., free of grooves or clearances.
Figure 28:
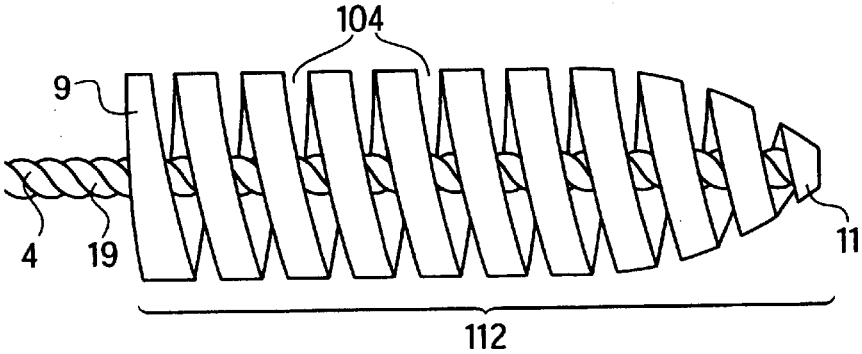
FIG. 28 is a schematic representation of a typical spiral row-like bristle envelope, i.e. having a spiral groove or clearance.
Figure 29:
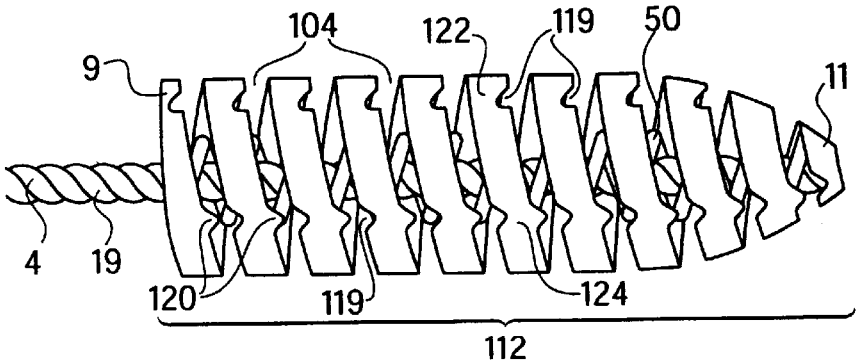
FIG. 29 is a schematic representation of a spiral row-like bristle envelope modified with a helix according to the present invention to yield anomalies in the groove or clearance.

In summary, to yield a final brush with a spiral row-like distribution (i.e., with a groove or clearance in the bristle envelope—as represented schematically in FIG. 28), the best results are achieved by providing a helix 50 to an original brush with an initial bristle distribution that is relatively uniform (i.e., a smooth bristle envelope free of grooves or clearances—as represented schematically in FIG. 27), and which has a core with more turns per inch than the helix. To yield a final brush with a uniform bristle distribution, i.e., a bristle envelope free of apparent grooves or clearances, comparable results are achieved by providing a helix 50 to an original brush with an initial bristle distribution that is either uniform or spiral row-like, and which has a core having fewer turns per inch than the helix.

The helix of the present invention is suitable for use with an original or initial brush having a bristle envelope or trim of any shape, such as, for example, a football shape, a straight shape (cylinder), a straight taper shape (conical), a duo shape (cylinder with tapered end), a curved shape (crescent), or other shapes.

The helix may be made from silver, or silver plating may be provided on the surface of the helix. Silver is known to provide strong antibacterial properties.

The present invention is also directed to a method for modifying a bristle portion of an original brush having a core defining a longitudinal axis, and wherein the bristle portion is formed by a plurality of radially extending bristles secured to the core. Each of the bristles of the original brush has a first orientation relative to the core. The method includes the steps of providing a helix formed from a plurality of successive loops and installing the helix over at least a part of the length of the bristle portion. The helix is adapted to be received coaxially around the core along at least part of the length of the bristle portion. The helix is dimensioned and installed such that the bristles extend radially between adjacent successive loops and such that at least some of the bristles are repositioned by the helix to a second orientation relative to the core. The helix is installed by axially rotating at least one of the helix and the core relative to the other.

As an illustration of a preferred embodiment, the following example is given:

EXAMPLE 1

A conventional brush is provided having a twisted wire core defining a longitudinal axis, and having a bristle portion formed by a plurality of radially extending nylon bristles secured to the core. Each of the bristles of the original brush has a first orientation relative to the core, such that an initial bristle distribution defines a spiral row-like bristle envelope (similar to that illustrated schematically in FIG. 28). The shape of the brush and arrangement of the bristles is similar to that of the brush 105 illustrated in FIG. 5B. The core of the brush has a diameter of approximately 1.43 mm (0.056 inch) and a length of approximately 40 mm (1.575 inches). The bristle portion supported on the distal end of the core has a generally cylindrical shape with a length of approximately 30 mm (1.181 inches) and a diameter of approximately 8 mm (0.315 inch). The cylindrical shape of the bristle portion tapers abruptly at the distal end to a diameter of approximately 2 mm (0.079 inch).

A cylindrical helix (similar in configuration to the helix illustrated in FIGS. 10–11) is provided having a body made from a 0.51 mm (0.020 inch) diameter stainless steel wire with a round section. The wire is formed into successive, evenly spaced loops to define the main portion of the cylindrical helix having an inside diameter of approximately 2.16 mm (0.085 inch). The cylindrical shape of the helix tapers abruptly at the distal end to a smaller inside diameter of approximately 1.52 mm (0.060 inch). The loops in the tapered portion are tightly wound, i.e., there is little or no space between adjacent loops in the tapered portion. The overall length of the helix is 28 mm (1.10 inches), with the main portion of the helix comprising approximately 26 mm (1.02 inches). The loops of the helix spiral such that a line perpendicular to the wire forms an angle of approximately 8 degrees relative to a longitudinal axis of the helix. The direction of spiral of the loops is opposite the direction of twist of the twisted wire core.

The helix is installed coaxially over the bristle portion much like a nut is installed on a screw thread, i.e., by rotating at least one of the brush or the helix relative to the other such that the helix is "screwed" onto the bristle portion. The rotating is continued until the reduced diameter of the tapered portion of the helix grasps the core of the brush in an interference fit. At that point, substantially all of the brush bristles extend radially between adjacent successive loops of the helix and at least some of the bristles are repositioned by the helix to a second orientation relative to the core to yield a final bristle distribution that is more uniform. This final bristle distribution is similar to that illustrated by brush 107 in FIG. 5B.

The dimensions recited in Example 1 are merely illustrative of a preferred embodiment, and are not intended to be limiting. It will be understood that numerous variations in dimensions and configuration can be made in accordance with the teachings set forth in the illustrations and written description herein without departing from the spirit of the invention and the scope of the claims below.

As will be clear from the foregoing written description, Example 1 and the Figures, the helix is particularly well suited for modifying the bristle portion of a brush having bristles extending radially from a core, each with a first orientation relative to the core of the brush. Thus, the underlying or original brush (before the added helix is installed) can be, for example, a conventional twisted wire brush of the type that is well known and readily available. The brush configuration of such an original brush can be modified in a variety of ways with the helix of the present invention. The cylinder-like helix has a body formed from a plurality of successive loops. The helix is dimensioned and has a pitch selected to be received coaxially around the core such that the bristles of the underlying brush extend radially outwardly between adjacent ones of the successive loops. At least some of the bristles are repositioned by the helix to a second pre-determined orientation relative to the core. This yields an altered brush with properties different from that of the original brush.

The invention will permit mascara brushes to be customized to suit a consumer's particular needs. For example, at a cosmetics counter, a consumer could select the characteristics desired in a mascara brush. A conventional (original) brush supplied with the mascara package could then be customized at the counter, i.e., modified to the customer's specifications, by installing a helix on the brush that would provide the desired characteristics. Alternatively, a do-it-yourself modification kit containing at least one helix can be offered to consumers directly to permit them to modify a conventional (original) brush. Each helix in such a kit would provide different characteristics to the original brush. The consumer could use the original brush without modification, or could choose the most suitable helix from the kit and install it to modify the brush characteristics as desired.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A brush comprising:

a central core having a length and defining a longitudinal axis;

a plurality of radially extending bristles secured along a portion of the length of the core; and a helix formed from a plurality of successive loops, the helix received coaxially around at least a part of the portion of the length the core such that the bristles extend radially between adjacent ones of the successive loops.

2. The brush of claim 1 wherein the plurality of bristles is initially secured to the core such that a first orientation relative to the core is defined for each of the plurality of bristles, and wherein a second orientation relative to the core is defined for at least some of the plurality of bristles by the helix.

3. The brush of claim 1 wherein the portion of the length of the core is formed from a pair of wire segments twisted in a first direction and wherein the bristles are secured to the core by being clamped between the twisted wire segments.

4. The brush of claim 3 wherein the loops of the helix spiral in a direction that is the same as or opposite from the first direction.

5. The brush of claim 1 wherein the helix defines a passage with a circular radial cross-section.

6. The brush of claim 1 wherein the helix defines a passage with a non-circular radial cross-section.

7. The brush of claim 1 wherein at least one of the plurality of successive loops defines a circular radial cross-sectional shape of the helix.

8. The brush of claim 1 wherein at least one of the plurality of successive loops defines a non-circular radial cross-sectional shape of the helix.

9. The brush of claim 1 wherein the helix has a body formed from one of a wire, a sheet material or a molded material.

10. The brush of claim 9 wherein the body is made from a metal or a plastic.

11. The brush of claim 9 wherein the body has a circular cross-section.

12. The brush of claim 9 wherein the body has a non-circular cross-sectional.

13. The brush of claim 1 wherein the core has an annular shoulder, and wherein an end of the helix is dimensioned to be received on the core against the shoulder.

14. The brush of claim 1 wherein tips of the plurality of bristles define a substantially smooth bristle envelope.

15. The brush of claim 1 wherein tips of the plurality of bristles define a bristle envelope having at least one clearance.

16. The brush of claim 2 wherein the at least some of the bristles are stiffer than others.

17. The brush of claim 1 wherein the helix further comprises silver.

18. The brush of claim 1 wherein the helix has a distal end aligned with a first end of the core, and the distal end supports one of a cap and a plug.

19. The brush of claim 18 wherein the one of the cap and the plug further supports a comb.

20. The brush of claim 1 wherein the helix is flocked.

21. The brush of claim 1 wherein the helix has a pitch and dimensions, and at least one of the pitch and the dimensions varies over a length of the helix.

22. The brush of claim 1 wherein the helix is secured to the core by anchoring means.

23. The brush of claim 22 wherein the anchoring means further comprises a portion of the helix which is reduced in diameter.

24. The brush of claim 22 wherein the anchoring means further comprises an extension of the helix which is secured to the core.

25. The brush of claim 22 wherein the anchoring means further comprises a member secured between a portion of the helix and a portion of the core.

26. The brush of claim 25 wherein the member further comprises a sleeve.

27. The brush of claim 1 wherein at least one of indents, perforations, grooves and projections is provided to a surface of the helix.

28. A method for modifying a bristle portion of a brush having a core defining a longitudinal axis, the bristle portion having a length and being formed by a plurality of radially extending bristles secured to the core, each of the bristles having a first orientation relative to the core, the method comprising:

providing a helix formed from a plurality of successive loops, the helix adapted to be received coaxially around the core along at least part of the length of the bristle portion; and installing the helix over the at least a part of the length of the bristle portion of the brush such that the bristles extend radially between adjacent ones of the plurality of successive loops and such that at least some of the bristles are repositioned by the helix to a second orientation relative to the core.

29. The method of claim 28 wherein the step of installing the helix further comprises inserting an end of the core in the helix and axially rotating at least one of the helix and the core relative to the other.

30. A device for modifying a bristle portion of a brush, the brush having a core defining a longitudinal axis, the bristle portion having radially extending bristles secured to the core, each of the bristles having a first orientation relative to the core, the device comprising:

a cylinder-like helix defined by a body forming a plurality of successive loops, the helix dimensioned and having a pitch selected to be received coaxially around the core such that the bristles extend radially between adjacent ones of the successive loops and such that at least some of the bristles are repositioned by the helix to a second pre-determined orientation relative to the core; and anchoring means for securing the helix to the core.

31. The device of claim 30 wherein the anchoring means further comprises a portion of the helix which is reduced in diameter.

32. The device of claim 30 wherein the anchoring means further comprises an extension of the helix which is adapted to be secured to the core.

33. The device of claim 30 wherein the anchoring means further comprises a member secured to the helix and adapted to be secured to the core.

34. The device of claim 30 wherein the member further comprises a sleeve.

* * * * *